United States Patent [19]

Mariotti

[11] 4,261,123

[45] Apr. 14, 1981

[54] SECTIONS FOR PICTURE FRAMES

[75] Inventor: Paolo Mariotti, Craighall Park, South Africa

[73] Assignee: Frame Investments Limited, Tortola, British Virgin Isls.

[21] Appl. No.: 28,860

[22] Filed: Apr. 10, 1979

[30] Foreign Application Priority Data

Apr. 12, 1978 [ZA] South Africa ..... 78/2102

[51] Int. Cl.[3] ..... A47G 1/06

[52] U.S. Cl. ..... 40/155; 40/152.1

[58] Field of Search ..... 40/155, 152, 152.1, 40/156

[56] References Cited

U.S. PATENT DOCUMENTS

| | | | |
|---|---|---|---|
| 3,386,198 | 6/1968 | Howell | 40/156 |
| 3,451,153 | 6/1969 | Dohanyos | 40/155 |
| 3,668,798 | 6/1972 | Mehl | 40/152.1 |
| 3,694,947 | 10/1972 | Mukai et al. | 40/152 |
| 3,753,306 | 8/1973 | Hemgrien | 40/605 |
| 3,916,549 | 11/1975 | Storch et al. | 40/152.1 |
| 3,946,511 | 3/1976 | Wienier, Jr. | 40/152.1 |
| 3,965,594 | 6/1976 | Candor | 40/152 |
| 3,965,600 | 6/1976 | Paskerian | 40/152.1 |
| 4,011,672 | 3/1977 | Grusin | 40/152.1 |
| 4,149,332 | 4/1979 | Horwitt | 40/155 |

*Primary Examiner*—Paul J. Hirsch

*Attorney, Agent, or Firm*—Leydig, Voit, Osann, Mayer & Holt, Ltd.

[57] ABSTRACT

Sections for making picture frames are described. Each section consists of a web with first and second flanges extending from the web on the same side thereof. The second flange has a lip extending away from the first flange. The sections may be made of plastics, preferably transparent or translucent, by extrusion.

2 Claims, 5 Drawing Figures

SECTIONS FOR PICTURE FRAMES

BACKGROUND TO THE INVENTION

This invention relates to picture frames and is particularly concerned with an extrusion of plastics material suitable for use as a picture frame.

Today it has become increasingly popular to minimise the effect of the frame itself on a framed picture, particularly when the picture is a print. Thus aluminium extrusions have been used, but these are relatively expensive and require corner brackets for their installation. Clips of a plastics material diagonally spanning each corner of a picture have also been used with the picture being clamped between a sheet of glass and a backing board. In practice, however, such clips do not fulfill the function of a picture frame which is to protect the picture and may cause the glass to break.

It is an object of the invention to provide an improved picture frame.

SUMMARY OF THE INVENTION

According to the invention there is provided an extruded section for an article to be framed, the section including a channel portion formed of a web, a first flange and a second flange extending on the same side of the web, and a lip portion extending from the second flange in a direction away from the first flange.

Preferably the material is a plastics and the plastics material is at least translucent and preferably transparent. Suitable plastics which may be used are acrylics, polystyrenes, polyethylenes, polyurethanes, and polyvinyl chlorides.

Preferably the first and second flange portions at each end of the web are inclined to one another in a direction away from the web, so that an article being framed and positioned between the flange portions will be resiliently engaged by the flange portions.

Preferably rib formations are provided on one of the flange portions to resist removal of an article engaged by the flange portions.

Preferably the first flange portion, which will be on the front or obverse side of the framed article is shorter than the second flange portion which will be on the reverse or rear side of the framed article.

In one form of the invention at least one of the first flange portions and the web is of thinner gauge than the second flange portion so that it will resiliently bend when the section is installed as a frame, the second flange portion remaining flush with the reverse of the article to be framed.

For this reason the second flange portion is preferably perpendicular to the web, while the first flange portion is inclined at an acute angle to the web.

In a preferred form of the invention a resilient flap is provided on the second flange on the side thereof facing the first flange, the flap extending from its connection to the second flange towards the web and at an inclination to the second flange. Preferably the flap is provided with longitudinal rib formations which, optimally, are serrated.

Preferably the web is formed with a plurality of closely spaced ribs or grooves. Conveniently these ribs or grooves are formed on the side of the web facing the flange portions. These ribs or grooves ensure that when the plastics is at least translucent or is transparent the sides of the article being framed are not clearly visible through the plastics.

The lip reinforces the second flange portion. More importantly, however, the lip facilitates installation of the section as a frame in that the lip can have a slot cut out of it at a portion adjacent each end of each section and a securing means, such as a clip, a length of wire, or an endless loop of elastic material, can pass through the slots of two adjacent sections and around the included corner to hold the sections to each other. Preferably to ensure firm location of the securing means, the lip is formed as a channel.

The invention also includes a framed article including sections as described above.

This invention is further discussed by way of example with reference to the drawings.

DESCRIPTION OF PREFERRED EMBODIMENTS OF THE INVENTION

Figure 1:
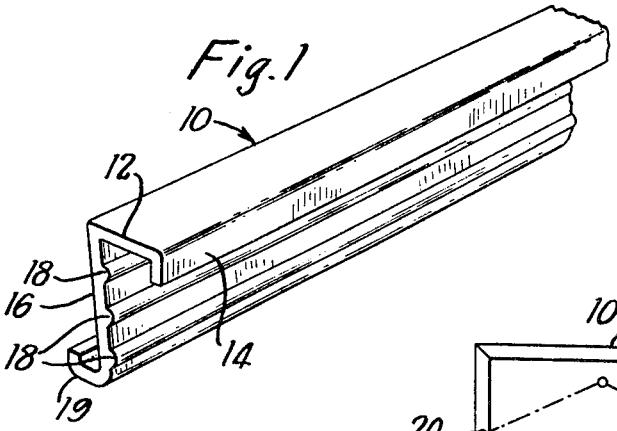
FIG. 1 shows one example of the invention.

FIG. 1 shows an extruded plastics section 10 of a suitable plastic, the section including a web 12, a first flange 14 inclined at an acute angle to the web 12 and a second flange portion 16 also inclined at an acute angle to the web 12. Ribs 18 are provided on the inner face of the second flange portions 16 to facilitate gripping of the section on to a backing sheet, such as of hard board, for a picture. A channel shaped lip 19 is provided on the end of the second flange portion 16.

Figure 2:
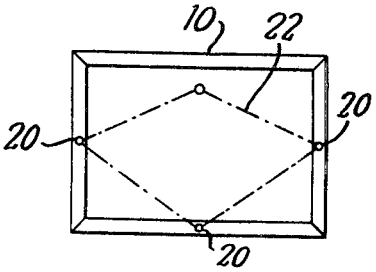
FIG. 2 shows schematically the extruded section of FIG. 1 installed as a picture frame.

FIG. 2 shows the section 10 in use as a frame, the back of the frame being shown. Four of the sections 10 each have their ends mitered at an angle of 45° as is conventional. The sections 10 each frictionally and resiliently engage a backing sheet for the picture to be displayed. As a safety feature and to permit hanging of the picture studs 20, which pass through the flange portion 16 and have a head at both ends, are provided on the side and lower sections 10. A loop of suitable picture hanging wire 22 passes around the studs and is used to hang the picture on a wall. As will be appreciated the loop 22 pulls the side sections inwardly and the lower section upwardly and this would be suitable especially for large frames as it ensures that the frame sections remain correctly positioned on the picture.

Figure 3:
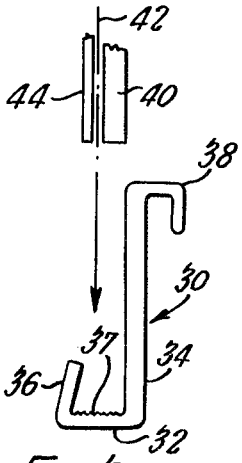
FIG. 3 shows an end view of an extruded plastic section of a preferred form of the invention.

FIG. 3 illustrates an end view of a preferred section 30 including a web 32, a back flange 34 perpendicular to the web 32, and a front flange 36 inclined at an acute angle to the web 32. The web 32 and flange 36 are of thinner material than the back flange 34. Ribs 37 are formed on the inner face of the web 32. Also provided on the flange 34 is a lip 38 which is also formed as a channel section. Shown exploded from the section 30 is an article to be framed comprising a backing sheet 40, a print 42 and a facing sheet of glass 44.

Figure 4:
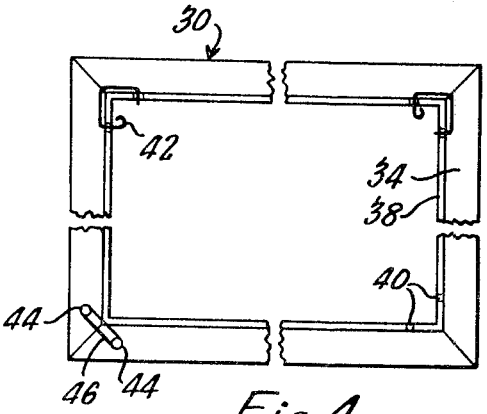
FIG. 4 shows the section of FIG. 3 installed as a picture frame.

FIG. 4 shows two methods of installation of the section 30. In one method, a slot 40 is cut adjacent each end of each lip 38 as seen in the lower right-hand corner. As shown in both upper corners of this FIG. a clip 42 of resilient wire is fitted to the frame such that it has a portion received under the lips 38 of two adjacent sections and has arms which extend through the slots 40 to a position where they are accessible. In the lower left-hand corner another method is shown in which studs 44 are provided adjacent each end of each section 30 and an endless loop of elastomeric material 46 is stretched across the studs 44. Another method, not shown, involves using an "elastic band" or endless loop of elastomeric material to engage in slots 40 cut adjacent the corners and partly under the lip 38.

A feature of the invention is that the sections 10 or 30 are made at least translucent and preferably transparent as discussed above. Suitable plastics would be apparent to persons skilled in plastic technology and examples are given above. Other extruded materials, such as brass or aluminium could also be used. Also the section could be formed by rolling, e.g. stainless steel strip.

The invention is not limited to the precise structural details disclosed herein and the various sections may be varied to fit a particular situation while still being within the scope of the appended claims.

In another form the invention provides that the extrusion is of aluminium or other similar extrudable material, the extrusion having a cross-section substantially as illustrated in FIG. 3 and including a channel section for receiving the periphery of an article to be framed and a lip on the back flange of the section, the lip being planar or channel shaped. In this event the article to be framed is a loose fit in the channel section and is held in position by spacer members inserted between the back of the article to be framed and the back flange of the extruded section. The sections are held on to the article to be framed by interconnecting the corners of adjacent sections using any of the methods disclosed in FIG. 4, i.e. a clip 42 which is located in slots 40 cut out of the lip or an elastic band or loop of wire passing through the slots 40 and around the corner, or by using studs 44 and a loop of elastomeric or other suitable material passing around the studs or as shown in FIG. 2 using studs 20 and a length of picture hanging wire 22. As will be appreciated the lip on the back flange need not be at the end of the back flange, but could also be anywhere along the length of the back flange.

Figure 5:
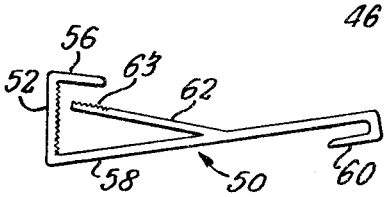
FIG. 5 shows an end view of a variant of the invention.

Yet another form of the invention is shown in FIG. 5. In this event the section 50 is of a plastics material, preferably transparent or translucent, and includes a web 52 formed with grooves or ribs 54, a first flange 56 and a second flange 58 on the same side of the web 52, a channel shaped lip 60, and a resilient flap 62 connected to the second flange 58, inclined to the second flange 58, extending towards the web 52 and formed with serrations 63. As shown the flanges 56, 58 are inclined towards each other and form an acute angle with the web 52. With this variant it is possible to frame pictures with different thicknesses of backing and/or glass as the flap 62 ensures that the picture inserted between the flap and flange 56 will be resiliently engaged by the section 50.

I claim:

1. A picture frame formed of sections each section including a channel portion formed of a web, a first flange and a second flange extending on the same side of the web and adapted to receive a picture between the flanges, a lip portion extending from the second flange in a direction away from the first flange, a resilient flap attached to the second flange and projecting at an acute angle to said second flange and directed towards the web, and means for holding the sections together to form a frame.

2. The picture frame of claim 1 wherein the holding means consists of a slot in each lip portion adjacent each end of each section, and a wire clip engaged in the slots of two adjacent sections and serving to hold the respective ends of the sections in face to face abutting relationship.

* * * * *